US008499692B2

(12) United States Patent
Binder et al.

(10) Patent No.: US 8,499,692 B2
(45) Date of Patent: Aug. 6, 2013

(54) ANILOX PRINTING UNIT AND PRINTING PRESS HAVING AN ANILOX PRINTING UNIT

(75) Inventors: Gisela Binder, Schwetzingen (DE); Suat Demir, Walldorf (DE); Jürgen Michels, Dossenheim (DE); Ulrich Pföhler, Neckargemünd (DE); Dieter Schaffrath, Lorsch (DE); Jörg Schilfahrt, Mauer (DE); Wolfgang Schönberger, Schriesheim (DE); Bernhard Schwab, Neustadt (DE); Michael Thielemann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1333 days.

(21) Appl. No.: 11/943,205

(22) Filed: Nov. 20, 2007

(65) Prior Publication Data

US 2008/0289523 A1 Nov. 27, 2008

(30) Foreign Application Priority Data

Nov. 20, 2006 (DE) ..... 10 2006 054 525

(51) Int. Cl.

| | |
|---|---|
| ***B41F 31/30*** | (2006.01) |
| ***B41F 31/32*** | (2006.01) |
| ***B41F 13/21*** | (2006.01) |
| ***B41F 13/24*** | (2006.01) |

(52) U.S. Cl.

USPC ..... 101/352.01; 101/352.03; 101/351.1; 101/351.2

(58) Field of Classification Search

USPC ..... 101/352.03, 352.08, 352.07, 352.05, 101/351.1, 351.2, 352.01, 350.1

See application file for complete search history.

(56) References Cited

U.S. PATENT DOCUMENTS 3,552,313 A * 1/1971 Jeschke ..... 101/218
3,618,516 A 11/1971 Jurny (Continued)

FOREIGN PATENT DOCUMENTS

DE 3926088 C1 10/1990
DE 4232163 A1 3/1994

(Continued)

*Primary Examiner* — Ren Yan
*Assistant Examiner* — Leo T Hinze
(74) *Attorney, Agent, or Firm* — Laurence A. Greenberg; Werner H. Stemer; Ralph E. Locher

(57) ABSTRACT

An anilox printing unit includes, as inking unit rolls, an ink applicator roll and an engraved roll mounted in rapid change roll sockets, for removing the engraved roll from the roll sockets and inserting another engraved roll into the roll sockets by an operator. The engraved roll is hollow and a temperature control fluid flows therethrough. The engraved roll and the ink applicator roll each have bearer rings. A device which presses the bearer rings of one inking unit roll against the bearer rings of the other inking unit roll has springs for compensating for diameter differences as a result of manufacturing tolerances between the bearer rings of the engraved roll and the bearer rings of the other engraved roll and for compensating for thermally induced diameter changes of the bearer rings of the engraved roll. A printing press having an anilox printing unit is also provided.

4 Claims, 5 Drawing Sheets

U.S. PATENT DOCUMENTS

| | | | | |
|---|---|---|---|---|
| 4,643,090 | A | 2/1987 | McKrell et al. | |
| 5,081,927 | A * | 1/1992 | Jahn | 101/218 |
| 5,189,960 | A * | 3/1993 | Valentini et al. | 101/487 |
| 5,228,390 | A | 7/1993 | Jahn | |
| 5,355,796 | A | 10/1994 | Kobler et al. | |
| 5,485,785 | A | 1/1996 | Schneider et al. | |
| 6,886,461 | B2 * | 5/2005 | Bolza-Schunemann | 101/352.06 |
| 7,389,728 | B2 | 6/2008 | Hieronymus et al. | |
| 2006/0096481 | A1 * | 5/2006 | Hieronymus et al. | 101/479 |

FOREIGN PATENT DOCUMENTS

| | | | |
|---|---|---|---|
| DE | 19947220 | A1 | 4/2001 |
| DE | 19947223 | A1 | 4/2001 |
| DE | 19947224 | A1 | 4/2001 |
| EP | 0193012 | B1 | 9/1986 |
| EP | 1088658 | B1 | 11/2005 |
| JP | 61138544 | U | 8/1986 |
| JP | 6040017 | A | 2/1994 |
| JP | 2006137189 | A | 6/2006 |

* cited by examiner

ANILOX PRINTING UNIT AND PRINTING PRESS HAVING AN ANILOX PRINTING UNIT

CROSS-REFERENCE TO RELATED APPLICATION

This application claims the priority, under 35 U.S.C. § 119, of German Patent Application DE 10 2006 054 525.7, filed Nov. 20, 2006; the prior application is herewith incorporated by reference in its entirety.

BACKGROUND OF THE INVENTION

Field of the Invention

The invention relates to an anilox printing unit which includes an ink applicator roll and an engraved roll. The invention also relates to a printing press having an anilox printing unit.

German Published, Non-Prosecuted Patent Application DE 10 2005 049 176 A1, corresponding to U.S. Patent Application Publication No. US 2006/0096481, describes an anilox printing unit which includes an ink applicator roll and an engraved roll. The engraved roll is hollow and a temperature control fluid flows through it, and the engraved roll is mounted in roll sockets which are configured as quick change devices or quick action closures, with the result that the engraved roll can be removed rapidly from the roll sockets and the printing press by the operator of the printing press and can be inserted into the roll sockets again. That is advantageous with regard to maintenance of the engraved roll which takes place outside the printing press, since the pattern structure of the engraved roll is only able to be cleaned thoroughly outside the printing press. Moreover, the roll sockets which are configured as quick change devices are advantageous with regard to a change of the engraved roll that takes place from print job to print job. For example, its pattern structure can be suitable for a defined print job and the pattern structure of another engraved roll can be suitable for a subsequent print job, with the result that one engraved roll has to be replaced by the other between the two print jobs. As a result of the fact that the roll sockets are configured as quick change devices, the operator can rapidly remove the engraved roll which is used in the preceding print job from the roll sockets and insert the other engraved roll into the roll sockets. There is a line coupling, through which the engraved roll is connected during roll installation to a temperature control fluid circuit and is disconnected from the latter again during roll dismantling. The temperature control fluid, preferably water, which is pumped into the hollow space of the engraved roll, serves to control the temperature of the engraved roll.

German Published, Non-Prosecuted Patent Application DE 199 47 223 A1 describes an anilox printing unit which includes an engraved roll, an ink applicator roll and a printing form cylinder that are equipped in each case with bearer rings. The ink applicator roll is thrown cyclically onto the printing form cylinder and thrown off it again. Springs are provided, by which the engraved roll is pressed against the ink applicator roll with a defined prestress. The engraved roll can follow the cycle movement of the ink applicator roll as a result of its sprung mounting.

European Patent No. EP 1 088 658 B1 describes an anilox printing unit, the engraved roll and ink applicator roll of which are equipped in each case with bearer rings. The ink applicator role is thrown cyclically onto the printing form cylinder and thrown off it again. Since the cycle movement of the ink applicator roll does not take place as a rotary movement about the center point of the engraved roll, axial spacing changes occur there between the ink applicator roll and the engraved roll. As a result of the sprung mounting of the engraved roll, the latter can follow the small positional changes of the ink applicator roll, with the result that the pressure between the ink applicator roll and the engraved roll remains constant.

European Patent No. EP 0 662 046 B1, corresponding to U.S. Pat. No. 5,485,785, describes an anilox printing unit, in which there is a temperature influence compensator, in order to keep an approximately constant width of a so-called roll strip, that is formed by pressure of the ink applicator roll on the form cylinder, during temperature changes of the ink applicator roll.

A problem which has not yet been solved by the prior art is to be seen in the manufacturing tolerances of the diameters of the bearer rings of the engraved roll. The bearer ring diameter can have a different size from engraved roll to engraved roll within the context of the tolerances. That has the consequence of there being a different pressure between the bearer rings of an engraved roll which is inserted into the roll sockets and the bearer rings of the ink applicator roll before an engraved roll change, than between the bearer rings of an engraved roll which is inserted into the roll sockets and the bearer rings of the ink applicator roll after the engraved roll change. The print quality is impaired by a change in the bearer ring pressure which is associated with the engraved roll change.

A very similar problem which has likewise not yet been solved by the prior art is to be seen in the thermally induced diameter changes of the bearer rings of the engraved roll. The temperature of the engraved roll is controlled through the use of the temperature control fluid in accordance with a setpoint temperature which can be different from print job to print job. The change in the temperature of the engraved roll which takes place between the print jobs and therefore of the bearer rings of the engraved roll, has the consequence of causing the bearer rings to have a slightly changed diameter in comparison with the other print job as a result of the temperature induced material expansion in one print job. That diameter change results in an undesirable change in the pressure between the bearer rings of the engraved roll and the bearer rings of the ink applicator roll.

BRIEF SUMMARY OF THE INVENTION

It is accordingly an object of the invention to provide an anilox printing unit and a printing press having an anilox printing unit, which overcome the hereinafore-mentioned disadvantages of the heretofore-known devices of this general type and in which the anilox printing unit is less sensitive. The invention is particularly based on the object of providing an anilox printing unit which is less sensitive with regard to temperature changes. The invention is especially based on the object of providing an anilox printing unit which is less sensitive with regard to manufacturing inaccuracies. In particular, it is the object of the invention to provide an anilox printing unit which is less sensitive with regard to diameter differences and changes of bearer rings.

With the foregoing and other objects in view there is provided, in accordance with the invention, an anilox printing unit, comprising roll sockets configured as quick change devices. Two inking unit rolls include an ink applicator roll and an engraved roll mounted in the roll sockets for removal of the engraved roll from the roll sockets and insertion of another engraved roll into the roll sockets by an operator. The engraved roll, the other engraved roll and the ink applicator roll each have bearer rings. A device is provided for pressing the bearer rings of one of the two inking unit rolls against the bearer rings of the other of the two inking unit rolls. The pressing device has springs for compensating for diameter differences due to manufacturing tolerances between the bearer rings of the engraved roll and the bearer rings of the other engraved roll.

The two engraved rolls can be absolutely structurally identical to one another, that is to say even with regard to the pattern structure, with one engraved roll being removed from the printing press for cleaning and the other engraved roll being a replacement engraved roll which is inserted into the printing press, in order to avoid machine down times during cleaning. It is likewise possible for the two engraved rolls to differ from one another with regard to their pattern structure, specifically with regard to what is known as their scooping volume, with one engraved roll being inserted into the printing press for a print job which requires more printing ink and the other engraved roll being inserted into the printing press for a print job which requires less printing ink. The permissible tolerances of the bearer ring manufacture are approximately 0.02 mm and, without the sprung mounting according to the invention, would make a check and optionally resetting of the bearer ring pressure necessary after the roll change. As a result of the mounting or setting mechanics according to the invention, which are based on spring force, one of the two rolls which bear against one another during printing operation (engraved roll (or replacement engraved roll) and ink applicator roll) is mounted in such a way that the roll has a certain resilience with regard to its position. As a result, there is a sufficient working window for the bearer ring pressure and the readjustment during the roll change is avoided.

In accordance with another feature of the invention, the roll sockets are disposed on pivoting levers which are loaded by the springs in such a way that the bearer rings of the engraved roll are pressed against the bearer rings of the ink applicator roll. In this case, one of the pivoting levers is situated on the drive side of the printing press and the other is situated on the operator side. One pivoting lever is assigned one roll socket and one spring and the other pivoting lever is assigned the other roll socket and the other spring. The roll which is secured in the roll sockets (the engraved roll or the replacement engraved roll) is loaded by the springs in such a way that the bearer rings of the roll are pressed against the bearer rings of the ink applicator roll during printing operation.

In accordance with a further feature of the invention, the ink applicator roll is mounted on the drive side and the operator side in each case in an eccentric bearing which has a plurality of eccentric bushings, one of which is loaded by one of the springs, with the result that the bearer rings of the ink applicator roll are pressed against the bearer rings of the engraved roll in a defined rotary position of the eccentric bearings. The eccentric bearings can be what are called double eccentrics which have an inner eccentric bushing and an outer eccentric bushing in each case. One of the two eccentric bushings of one eccentric bearing is loaded by one spring and one of the two eccentric bushings of the other eccentric bearing is loaded by the other spring. The spring loading of the eccentric bushings is such that, in their rotary position which is provided for printing operation, the bearer rings of the ink applicator roll are pressed against the bearer rings of the engraved roll or against the bearer rings of the replacement engraved roll, depending on which of the two engraved rolls is inserted into the roll sockets.

In accordance with an added feature of the invention, the ink applicator roll is mounted on the drive side and the operator side in each case in a control cam which is clamped between a plurality of supporting rolls, one of which is loaded by one of the springs, with the result that the bearer rings of the ink applicator roll are pressed against the bearer rings of the engraved roll in a defined rotary position of the control cams. In this embodiment, the eccentric bearings of the embodiment which is described in the preceding text are replaced by control cams. The control cams are radial cams in the form of annular disks. The cam contour is situated on the external circumference of the respective control cam. The control cam which is disposed on the drive side is supported on three supporting rolls and the control cam which is disposed on the operator side is likewise supported on three supporting rolls. One of the three operator-side supporting rolls is sprung and one of the three drive-side supporting rolls is sprung, with the result that, in the rotary and switching position of the control cams which is provided for printing operation, the sprung supporting rolls load the control cams together with the ink applicator roll which is mounted rotatably in them, in such a way that the bearer rings of the ink applicator roll are pressed against the bearer rings of the engraved roll for the replacement engraved roll, depending on which of the two engraved rolls is inserted into the roll sockets.

In accordance with an additional feature of the invention, the engraved roll is hollow and a temperature control fluid flows through it. The temperature control fluid serves to control the temperature of the engraved roll to an operating temperature. The hollow space within the engraved roll can be formed by one or more channels for the temperature control fluid. The replacement engraved roll has a structurally identical configuration to the engraved roll with regard to the hollow space and the temperature control. The temperature control fluid is preferably water and circulates within a temperature control fluid circuit which has a circulating pump and in which the engraved roll or the replacement engraved roll is connected, depending on which of the two engraved rolls is inserted into the roll sockets.

With the objects of the invention in view, there is also provided an anilox printing unit, comprising two inking unit rolls including an ink applicator roll and a hollow engraved roll through which a temperature control fluid flows. The engraved roll and the ink applicator roll each have bearer rings. A device for pressing the bearer rings of one of the two inking unit rolls against the bearer rings of the other of the two inking unit rolls has springs for compensating for thermally induced diameter changes of the bearer rings of the engraved roll.

In this printing unit according to the invention, it is possible to control the temperature of the engraved role in a variable manner within a temperature range of from 20° C. to 45° C. For example, the engraved roll can be kept at an operating temperature which is approximately 25° C. for one print job and at an operating temperature which is approximately 40° C. for another print job. As a result of the selection of the operating temperature of the engraved roll, the rheological properties of the printing ink which is situated on the engraved roll can be influenced, in order to control the amount of the printing ink which is dispensed from the engraved roll to the ink applicator roll. In this case, the temperature of the ink applicator roll can likewise be controlled and can be kept to an operating temperature which is constant from print job to print job and is, for example, approximately 30° C. To this end, the engraved roll can be connected into the first temperature control fluid circuit and the ink applicator roll can be connected into the second temperature control fluid circuit. As a result of the variation in the operating temperature of the engraved roll, its diameter changes. If the diameter of the engraved roll is, for example, approximately 200 mm, the diameter expands by 0.024 mm as a consequence of a temperature increase by 10 Kelvin. This means that the roll radius deviates by 0.03 mm within the above-mentioned working range of from 20° C. to 45° C. The thermally induced diameter change of the engraved roll and the bearer rings of the engraved roll would inevitably result, in the case of the non-resilient mounting both of the engraved roll and of the ink applicator roll (the axial spacing between the two rolls would then be rigid), in an undesired change in the pressure between the engraved roll and the bearer rings of the ink applicator roll. The bearer ring pressure could change by from 20% to 30%. A corresponding increase in the bearer ring pressure would result in excess wear and a corresponding reduction in the bearing pressure would result in an impairment of the function of the bearings. An increase or reduction in the bearer ring pressure of this type as a consequence of the temperature control of the engraved roll is avoided in the anilox printing unit according to the invention by the engraved roll or the ink applicator roll being mounted resiliently through the use of the springs.

In accordance with yet another feature of the invention, the engraved roll is mounted in roll sockets which are configured as quick change devices, with the result that the engraved roll can be removed from the roll sockets by the operator and another engraved roll can be inserted into the roll sockets.

In accordance with yet a further feature of the invention, the ink applicator roll is mounted on the drive side and the operator side in each case in an eccentric bearing which has a plurality of eccentric bushings, one of which is loaded by one of the springs, with the result that the bearer rings of the ink applicator roll are pressed against the bearer rings of the engraved roll in a defined rotary position of the eccentric bearings.

In accordance with yet an added feature of the invention, the ink applicator roll is mounted on the drive side and the operator side in each case in a control cam which is clamped between a plurality of supporting rolls, one of which is loaded by one of the springs, with the result that the bearer rings of the ink applicator roll are pressed against the bearer rings of the engraved roll in a defined rotary position of the control cams.

In accordance with yet an additional feature of the invention, the roll sockets are disposed on pivoting levers which are loaded by the springs in such a way that the bearer rings of the engraved roll are pressed against the bearer rings of the ink applicator roll.

In the two anilox printing units according to the invention, the same device, namely the device which is equipped with the springs, is used in principle for the same purpose, namely in order to prevent the undesirable change in the pressure between the bearer rings of the engraved roll and the bearer rings of the ink applicator roll, or at least to minimize it to a sufficient extent. In one case, this is as a result of manufacturing tolerances of the bearer rings and, in the other case, the thermally induced diameter changes of the bearer rings are the assumed cause for the prevented change in pressure of the bearer rings. In an anilox printing unit which has both the roll sockets which are configured as quick change devices and the engraved roll, through which the temperature control fluid flows, the compensating device prevents both the change in bearing pressure which would otherwise result from the diameter differences as a result of manufacturing tolerances as well as the thermally induced diameter change of the bearer rings.

With the objects of the invention in view, there is concomitantly provided a printing press which is equipped with one of the anilox printing units according to the invention. The printing press is preferably a sheet-fed offset printing press.

Other features which are considered as characteristic for the invention are set forth in the appended claims.

Although the invention is illustrated and described herein as embodied in an anilox printing unit and a printing press having an anilox printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
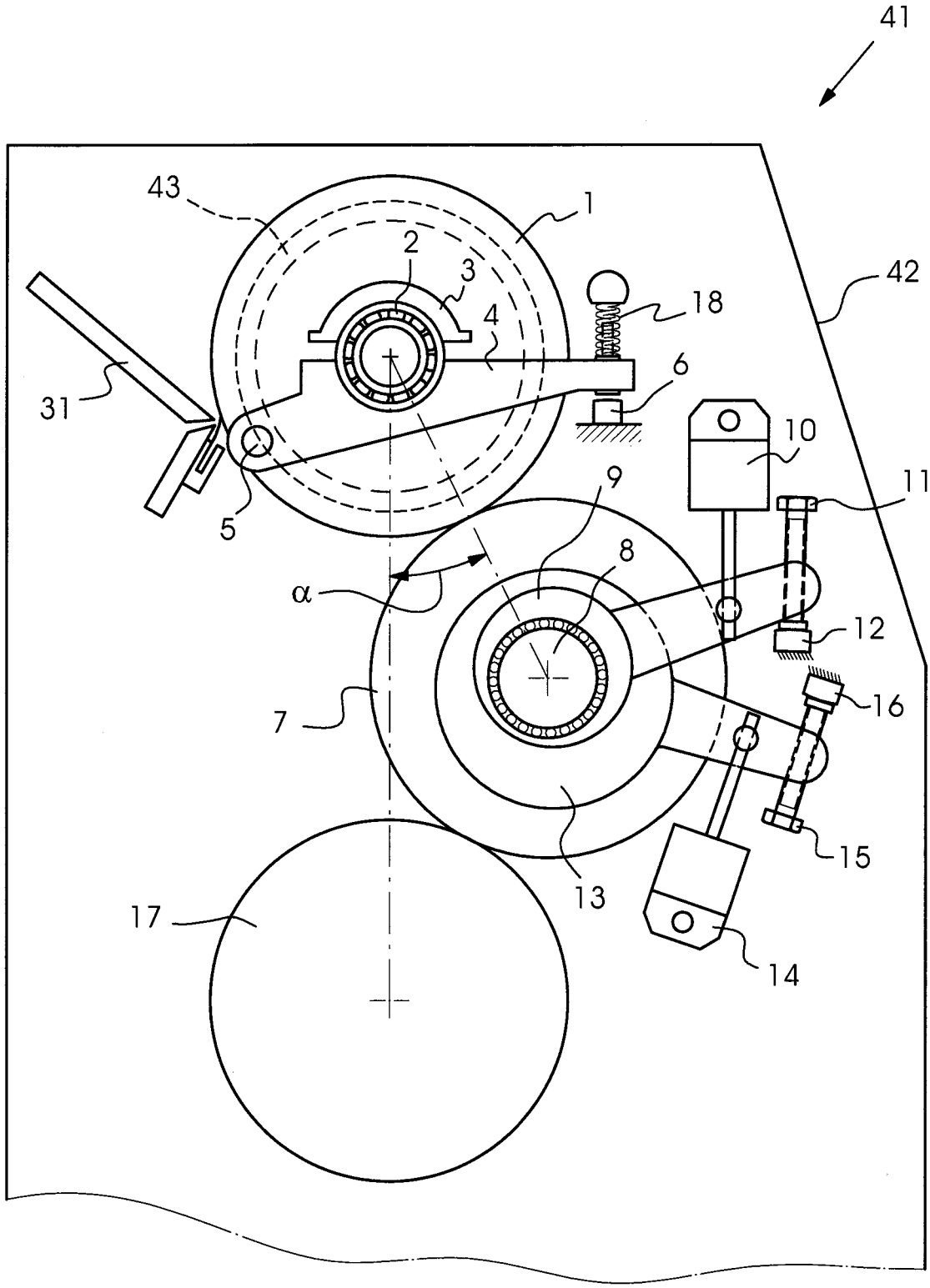
FIG. 1 is a fragmentary, diagrammatic, side-elevational view of a first exemplary embodiment, in which an engraved roll is mounted in sprung pivoting levers and an ink applicator roll is mounted in a double eccentric bearing.

Referring now in detail to the figures of the drawings, in which components and elements that correspond to one another are denoted by the same designations, and first, particularly, to FIG. 1 thereof, there is seen a section of a printing press 41. The section shows an anilox printing unit 42 of the printing press 41. The anilox printing unit 42 includes an engraved roll 1, an ink applicator roll 7 and a printing form cylinder 17. Moreover, the anilox printing unit 42 includes a blanket cylinder and an impression cylinder which are not shown in the drawing. A doctor-type ink fountain 31 bears against the engraved roll 1, in order to supply printing ink to the engraved roll 1.

Rotational bearings 2, which are mounted releasably in roll sockets 3 by the operator, are seated on axle journals of the engraved roll 1. The rotational bearings 2 are roller bearings. The roll sockets 3 are disposed in each case on a pivoting lever 4 which can be pivoted about a joint 5. Each pivoting lever 4 is loaded by a spring 18 which is supported on the pivoting lever 4 at one end and is supported on a journal that is fixed in a machine frame at its other end. The pivoting levers 4 are coordinated in each case with a stop 6, with which the respective pivoting lever 4 or a part that is fastened to it come into contact when the engraved roll 1 is removed from the roll sockets 3. The stop 6 is not contacted when the engraved roll 1 is secured in the roll sockets 3.

Figure 2:
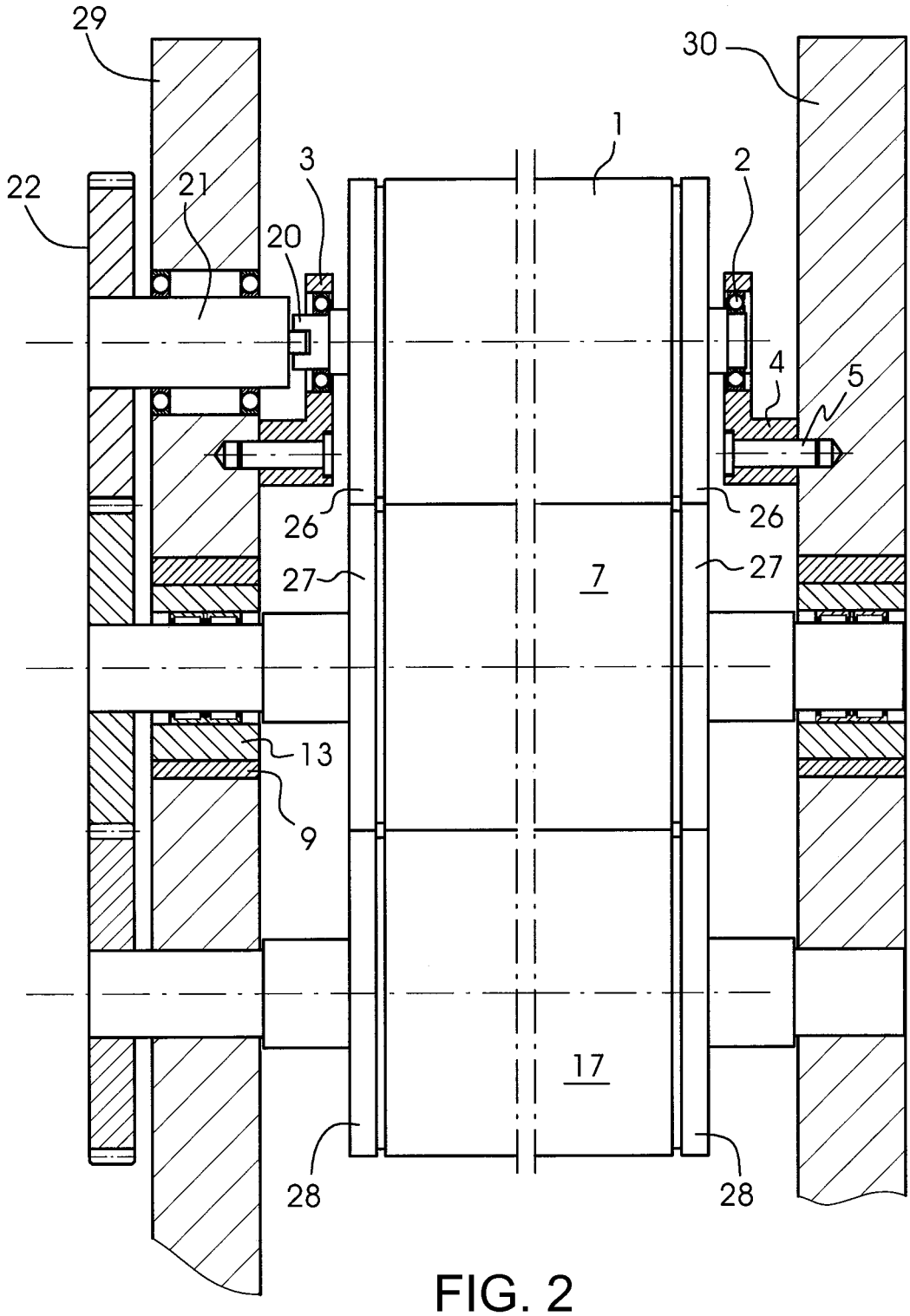
FIG. 2 is a fragmentary, cross-sectional view of the anilox printing unit of FIG. 1.

As is seen in FIG. 2, the machine frame includes a side wall 29 on the drive side of the printing press 41 and a side wall 30 on the operator side. The rotation of the engraved roll 1 is driven by a main motor of the printing press 41 through a gear train 22, to which a gearwheel that is seated on a drive shaft 21 belongs. The drive shaft 21 is connected to the drive-side journal of the engraved roll 1 through a coupling 20, which is closed when the engraved roll 1 is introduced into the roll sockets 3 and is opened when the engraved roll 1 is removed from the roll sockets 3.

As is seen in FIG. 1, the ink applicator roll 7 is mounted rotatably on the drive side and the operator side in each case in an eccentric bearing 8 which includes a first eccentric bushing 9 and a second eccentric bushing 13 that is mounted rotatably in the first eccentric bushing 9. The first eccentric bushing 9 has an arm, through which an actuating drive 10 for rotating the first eccentric bushing 9 is articulated on the first eccentric bushing 9. The rotation of the first eccentric bushing 9 is delimited by a stop 12 which is fixed to the frame and with which a screw 11 that is attached to the first eccentric bushing 9 comes into contact. The switching position of the first eccentric bushing 9, which is defined by the stop 12, can be adjusted by screwing the screw 11 into the arm to a greater or lesser depth. The second eccentric bushing 13 is equipped with an arm, on which an actuating drive 14 is articulated for rotating the second eccentric bushing 13. In order to adjust the switching position of the second eccentric bushing 13, the screw 15 can be screwed into the arm to a greater or lesser depth. When it reaches the switching position, the screw 15 comes into contact with a stop 16 which is fixed to the frame. The actuating drives 10 and 14 are pneumatic working cylinders, the piston rods of which are connected to the eccentric bushings 9, 13, and could likewise be electric motors, the motor shafts of which are configured as threaded spindles. The ink applicator roll 7 can be thrown onto and off the engraved roll 1 by actuation of the actuating drive 10. The ink applicator roll 7 can be thrown onto and off the printing form cylinder 17 by actuation of the actuating drive 14.

As is seen in FIG. 1, an angle $\alpha$, which is more than 0° and at most 45°, is enclosed between a connecting center line of the rotational axes of the engraved roll 1 and the printing form cylinder 17 and a connecting central line of the engraved roll 1 and the ink applicator roll 7. The engraved roll 1 has one respective bearer ring 26 on each of the drive side and the operator side. During printing operation, the two bearer rings 26 of the engraved roll 1 bear against the same type of bearer rings 27 of the ink applicator roll 7. The bearer rings 27 of the ink applicator roll 7 also bear against bearer rings 28 of the printing form cylinder 17.

The system which is shown in FIGS. 1 and 2 functions as follows: the pivoting levers 4 are kept in contact with the stops 6 by the springs 18. In this state, the operator can set the pressure between the bearer rings 26 of the engraved roll 1 and the bearer rings 27 of the ink applicator roll 7 by rotation of the screw 11. The coordination between the bearer ring prestressing force and the prestress of the springs 18 is selected in such a way that, during the setting of the bearer ring pressure, the contact between the pivoting levers 4 and the stops 6 is canceled, as is shown in FIG. 1.

A minimum reduction in the external diameter of the bearer rings 26 of the engraved roll 1 as a consequence of cooling or an exchange of the engraved roll 1 is compensated for by the prestressing force of the springs 18, with the result that the bearer ring pressure remains constant. A minimum increase in the diameter of the bearer rings 26 of the engraved roll 1 is likewise compensated for by the prestressing force of the springs 18 and the bearer ring pressure is kept constant. A minimum increase in the bearer ring diameter can be a consequence of an exchange of the engraved roll 1, in which the diameters of the bearer rings 26 of the engraved roll 1 are greater than the diameters of the bearer rings of another engraved roll which was situated in the roll sockets 3 before the engraved roll 1 was inserted into the roll sockets 3. A minimum increase in the bearing diameter can likewise result from heating of the engraved roll 1 and of its bearer rings 26, in which the heating and the thermally induced bearer ring widening is caused by temperature control of the engraved roll 1. In this temperature control, a temperature control fluid flows through an annular temperature control channel 43 within the engraved roll 1.

Figure 3:
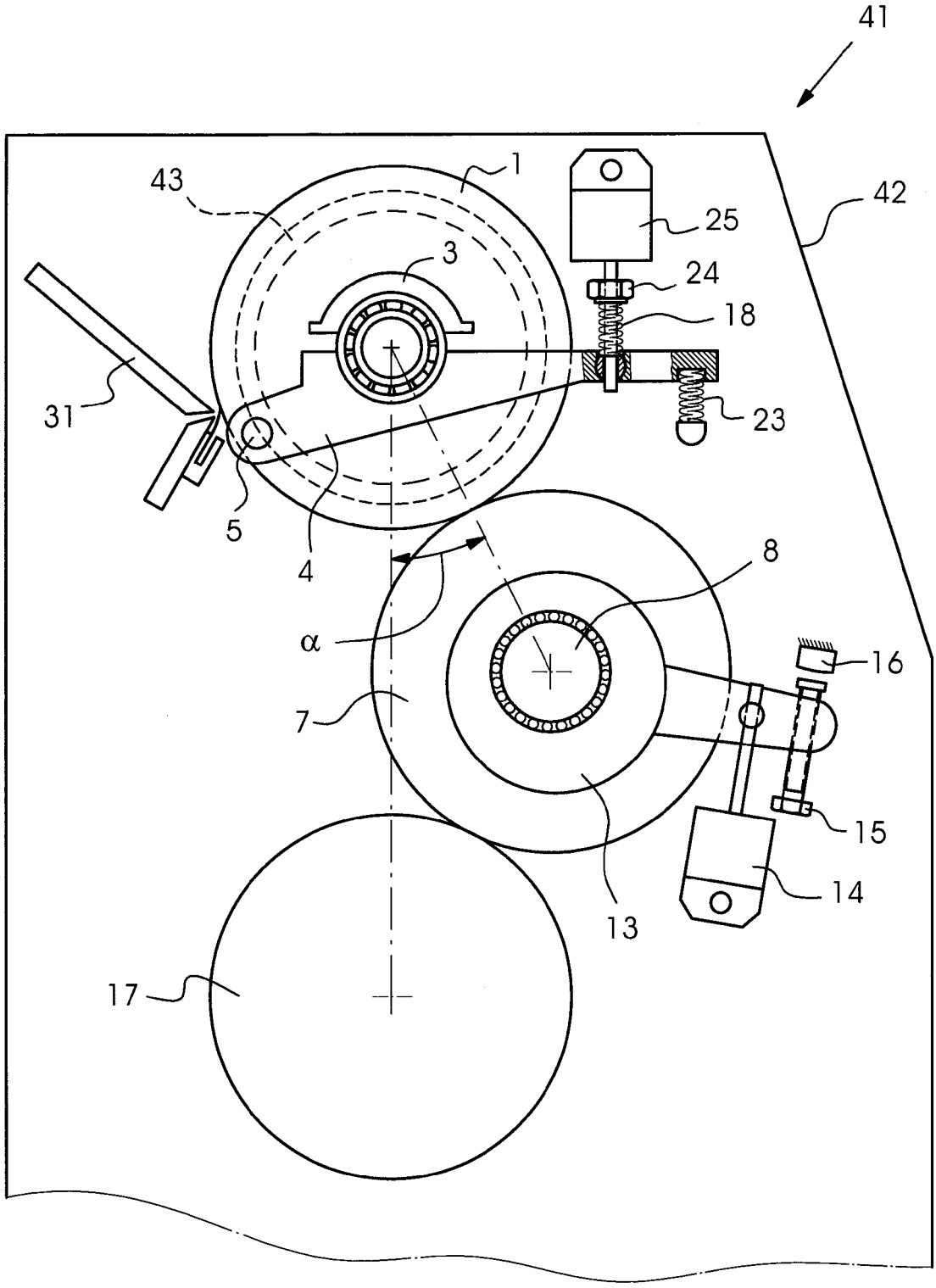
FIG. 3 is a view similar to FIG. 1 of a second exemplary embodiment, in which the engraved roll is mounted in sprung pivoting levers and the ink applicator roll is mounted in a single eccentric bearing.

FIG. 3 shows an exemplary embodiment which differs from the exemplary embodiment that is shown in FIGS. 1 and 2, only with regard to the configuration of the eccentric bearings 8 and with regard to the sprung mounting of the pivoting levers 4. As a result, the description of the remaining features of the previous exemplary embodiment is also valid for the exemplary embodiment which is shown in FIG. 3.

In this exemplary embodiment, the eccentric bushing 13 is the only eccentric bushing of the respective eccentric bearing 8 and the respective pivoting lever 4 is connected to an actuating drive 25 for pivoting the pivoting lever 4. The actuating drive 25 serves to pivot the pivoting lever 4, counter to the force of a spring 23 which loads the pivoting lever 4, in the direction in which the engraved roll 1 is thrown onto the ink applicator roll 7. The actuating drive 25 loads the pivoting lever 4 through the spring 18, the force of which is greater than that of the spring 23. A nut 24 serves to set the prestress of the spring 18. The actuating drive 25 is a pneumatic working cylinder, and the spring 18, which is a compression spring, is seated on a piston rod of the pneumatic working cylinder. The spring 18 is supported on the pivoting lever 4 with one end and on the nut 24 with its other end, optionally through a washer, and the nut 24 is screwed onto the piston rod. The spring 23, which loads the pivoting lever 4 in the opposite direction to the spring 18, is supported on the pivoting lever 4 with one end and on the journal which is fixed to the frame with the other end.

The system which is shown in FIG. 3 functions as follows: as a result of the actuation of the eccentric bearings 8 on the drive side and on the operator side, which takes place through the use of the actuating drives 14, the ink applicator roll 7 can be thrown onto the printing form cylinder 17 and can be thrown off the latter again. As a result of the actuating movement of the drive-side and operator-side actuating drives 25, that is to say as a result of the extension of their piston rods, the springs 18 are prestressed, with the result that a prestress is set between the bearer rings 26 of the engraved roll 1 and the bearer rings 27 of the ink applicator roll 7 (see FIG. 2). This bearer ring pressure can be adjusted by the nut 24 of the respective actuating drive 25 being screwed toward the pivoting lever 4 or away from the latter. In order to cancel the contact between the engraved roll 1 and the ink applicator roll 7 and between the bearer rings 26 of the engraved roll 1 and the bearer rings 27 of the ink applicator roll 7, the actuating drives 25 are actuated in the opposite direction, which can take place by switching off compressed air loading in the preferred configuration of the actuating drives 25 as pneumatic working cylinders. After the compressed air loading is switched off, the springs 23 are able to pivot the pivoting levers 4 counter to the clockwise direction with regard to FIG. 3, with the springs 23 pressing the piston rods of the actuating drives 25 into the latter. The springs 23 act, as it were, as restoring springs of the actuating drives 25 and, when the actuating drives 25 are deactivated, hold the pivoting levers 4 in a position in which the engraved roll 1 and its bearer rings 26 are thrown off the ink applicator roll 7 and its bearer rings 27. If the diameters of the bearer rings 26 of the engraved roll 1 vary or change for the above-described reasons, the bearer ring diameter difference which results therefrom is compensated for by the springs 18 which keep the pressure between the bearer rings 26, 27 substantially constant.

Figure 4:
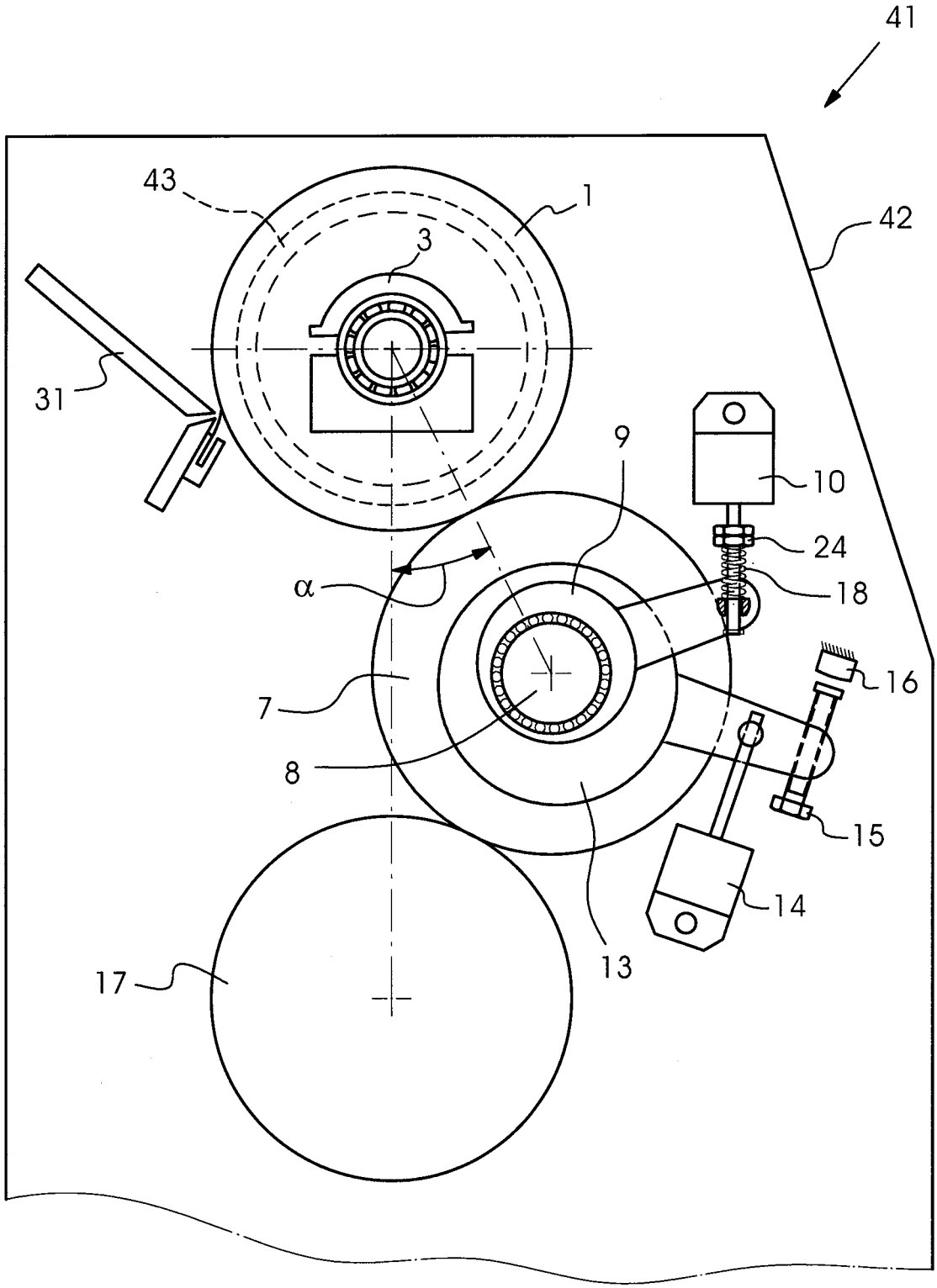
FIG. 4 is a view similar to FIGS. 1 and 3 of a third exemplary embodiment, in which the engraved roll is mounted in an unsprung manner and the ink applicator roll is mounted in a double eccentric bearing having a sprung eccentric bushing.

FIG. 4 shows an exemplary embodiment which differs from the exemplary embodiment that is shown in FIGS. 1 and 2, only with regard to the configuration of the roll sockets 3 and the sprung mounting of the eccentric bearing 8. The description of the remaining features of the exemplary embodiment according to FIGS. 1 and 2 is also valid for the exemplary embodiment in FIG. 4 in a transferred sense.

In this exemplary embodiment, the two roll sockets 3 are attached in a fixed manner to the frame, that is to say in a stationary manner on the machine frame. The actuating drive 10, which rotates the first eccentric bushing 9 of the respective eccentric bearing 8, is sprung through the use of the spring 18 (in a manner which is comparable with the actuating drive 25 in FIG. 3). It is possible for the prestress of the spring 18 to be set through the use of the nut 24. The screws 11 and the stops 12 (see FIG. 1) are omitted in the exemplary embodiment which is shown in FIG. 4.

The exemplary embodiment functions as follows: in order to throw the ink applicator roll 7 onto the engraved roll 1, the piston rod of the actuating drive 10 is extended. In this case, the actuating drive 10 acts on the first eccentric bushing 9 through the spring 18 which is supported through the nut 24 on the actuating drive 10 with one end and is supported with its other end through a journal in the arm of the first eccentric bushing 9. As a result of the switching movement of the actuating drive 10, the spring 18 is prestressed if the first eccentric bushing 9 moves into its end position, that is to say if the bearer rings 27 of the ink applicator roll 7 come into contact with the bearer rings 26 of the engraved roll 1 (see FIG. 2). The magnitude of the prestress of the springs 18 on the drive side and on the operator side defines the magnitude of the bearing pressure and can be adjusted by the nut 24 of the respective actuating drive 10. If the diameters of the bearer rings 26 of the engraved roll 1 vary or change for the above-described reasons, the bearer ring diameter difference which results therefrom is compensated for by the springs 18, which keep the pressure between the bearer rings 26, 27 substantially constant.

Figure 5:
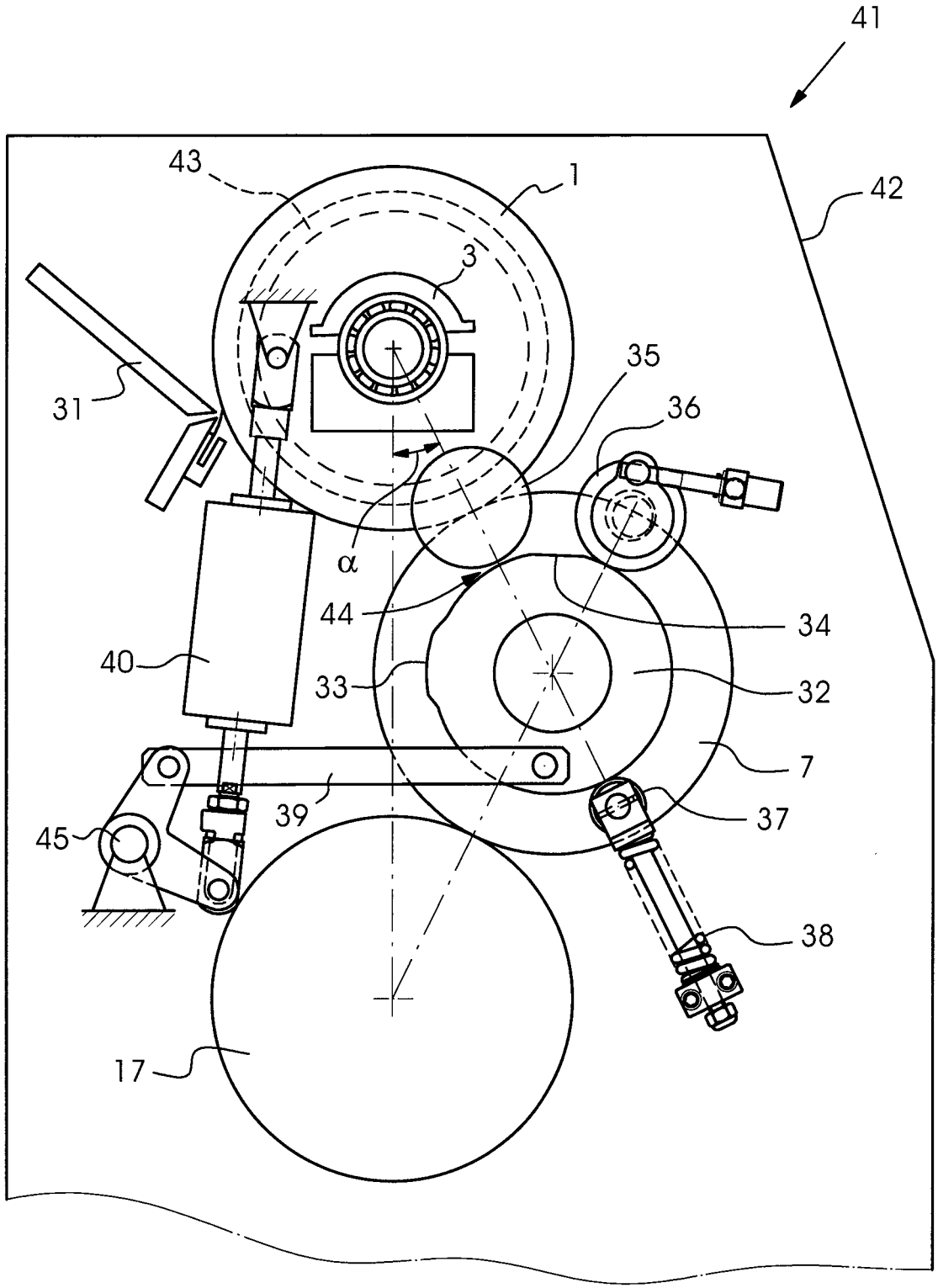
FIG. 5 is a view similar to FIGS. 1, 3 and 4 of a fourth exemplary embodiment, in which the engraved roll is mounted in an unsprung manner and the ink applicator roll is mounted in a control cam having a sprung supporting roll.

FIG. 5 shows an exemplary embodiment, in which the roll sockets 3 are disposed in a fixed manner on the frame, as in the exemplary embodiment according to FIG. 4. The ink applicator roll 7 is mounted rotatably on the drive side and on the operator side in one control cam 32 in each case. Each respective control cam 32 is an annular disk and, on its circumferential surface, has a cam profile which includes an elevation 33 and a depression 34. Each control cam 32 is assigned a fixed supporting roll 35, an adjustable supporting roll 36 and a supporting roll 37 which is sprung through the use of a spring 38. A circumferential point of the control cam 32, at which the adjustable supporting roll 36 bears against the control cam 32, is diametrically opposed to a circumferential point of the ink applicator roll 7, at which the printing form cylinder 17 bears against the ink applicator roll 7. The adjustable supporting roll 36 is disposed, as it were, on the extension line of the connecting center lines of the rotational axes of the printing form cylinder 17 and the ink applicator roll 7. The fixed supporting roll 35 is disposed on the connecting center lines of the rotational axes of the engraved roll 1 and the ink applicator roll 7, and the sprung supporting roll 38 is disposed diametrically opposite the fixed supporting roll 35 on the extension of those connecting center lines. The direction of the last-mentioned connecting center lines also corresponds to the direction of action of the spring 38 which attempts to press the ink applicator roll 7 against the engraved roll 1 through the sprung supporting roll 37 and the control cam 32 and in the process to press the bearer rings 27 of the ink applicator roll 7 against the bearer rings 26 of the engraved roll 1. An actuating drive 40 for rotating the control cam 32 is connected to the latter in terms of gear technology through a coupler mechanism 39. The control cam (which is not shown in FIG. 5) on the machine side (which is also not shown in FIG. 5) can be rotated through a further coupler mechanism of this type. The two coupler mechanisms on the drive side and the operator side are connected to one another through a common shaft 45. The actuating drive 40 is therefore a common actuating drive for the synchronous rotation of both control cams.

It should be noted at this point that the actuating drives 10, 14 and 25 which are shown in FIGS. 1, 3 and 4 can also likewise be common actuating drives of this type for actuating both pivoting levers 4 or both eccentric bearings 8.

The adjustable supporting rolls 36 in FIG. 5 are mounted in each case in an eccentric bearing which makes it possible to set the pressure between the ink applicator roll 7 and the printing form cylinder 17. During printing operation when the ink applicator roll 7 is thrown onto the engraved roll 1 and the printing form cylinder 17, a gap 44 is situated between the fixed supporting roll 35 and the control cam 32. The force of the springs 38 of the sprung supporting rolls 37 on the drive side and the operator side is dimensioned in such a way that it applies the weight of the ink applicator roll 7, the contact forces between the bearer rings 27 of the ink applicator roll 7 and the bearer rings 26 of the engraved roll 1, and the contact forces in the contact zone of the role barrels or bodies of the rolls 1 and 7.

The system which is shown in FIG. 5 functions as follows: if a temperature change of the engraved roll 1 leads to a change in the diameter of the bearer rings 26 of the engraved roll 1, this is compensated for by the sprung supporting rolls 37, with the result that the contact forces between the bearer rings 26 of the engraved roll 1 and the bearer rings 27 of the ink applicator roll 7 are kept substantially constant. The temperature change cannot therefore cause excess pressure of the bearer rings 26, 27 nor underpressure. In order to throw the ink applicator roll 7 off the engraved roll 1, the control cams 32 are rotated in the clockwise direction with regard to FIG. 5, with the result that the elevation 33 of the respective control cam 32 comes into contact with the fixed supporting roll 35 and, as a result, the control cams 32 together with the ink applicator roll 7 are displaced in the direction of the sprung supporting rolls 37 which yield with slight compression of the springs 38. In this rotational position of the control cams 32, the engraved roll 1 can be removed from the roll sockets 3 and another engraved roll can be inserted into the roll sockets 3. When the ink applicator roll 7 is thrown onto the other engraved roll, which takes place after the engraved roll change, the correct pressure between the bearer rings 27 of the ink applicator roll 7 and the bearer rings 26 of the other engraved roll is set automatically by the sprung supporting rolls 37. Deviations as a result of manufacturing tolerances between the diameters of the bearer rings 26 of the removed engraved roll 1 and the bearer rings of the inserted other engraved roll, are thus compensated for.

In order to throw the ink applicator roll 7 off the printing form cylinder 17, the control cam 32 is rotated into a rotational position, in which the depression 34 is situated under the adjustable supporting roll 36.

The invention claimed is:

1. An anilox printing unit, comprising:

a drive side and an operator side;

a plurality of supporting rolls;

control cams each disposed on a respective one of said drive side and said operator side and clamped between said plurality of supporting rolls;

a printing form cylinder having a rotational axis;

roll sockets configured as quick change devices;

two inking unit rolls including an ink applicator roll having a rotational axis and an engraved roll having a rotational axis, said ink applicator roll being mounted in said control cams on said drive side and said operator side, said engraved roll being mounted in said roll sockets for permitting removal of said engraved roll from said roll sockets and insertion of another engraved roll into said roll sockets by an operator, said engraved roll, said other engraved roll and said ink applicator roll each having bearer rings, said ink applicator roll bearing against said engraved roll and said printing form cylinder during printing operation;

said rotational axes of said engraved roll and said printing form cylinder defining a connecting center line therebetween, said rotational axes of said engraved roll and said ink applicator roll defining another connecting center line therebetween, and said connecting center lines enclosing an angle of more than 0° and at most 45° therebetween; and a device for pressing said bearer rings of one of said two inking unit rolls against said bearer rings of the other of said two inking unit rolls, said pressing device having springs for compensating for diameter differences due to manufacturing tolerances between said bearer rings of said engraved roll and said bearer rings of said other engraved roll;

one of said supporting rolls being loaded by one of said springs for pressing said bearer rings of said ink applicator roll against said bearer rings of said engraved roll in a defined rotary position of said control cams, and another of said supporting rolls being a fixed supporting roll disposed on said other connecting center line.

2. The anilox printing unit according to claim 1, wherein said engraved roll is hollow and a temperature control fluid flows through said engraved roll.

3. A printing press, comprising a plurality of printing units, one of said printing units being an anilox printing unit according to claim 1.

4. The anilox printing unit according to claim 1, wherein said fixed supporting roll is disposed diametrically opposite said supporting roll loaded by said spring.

* * * * *